US006085671A

United States Patent [19]

Kerr et al.

[11] Patent Number: 6,085,671

[45] Date of Patent: Jul. 11, 2000

[54] LOCK BOX

[76] Inventors: William A. Kerr, 16183 Royal Oak Rd., Encino, Calif. 91436; William B. Kerr, 22 Dapple Grey Rd., Bell Canyon, Calif. 91307

[21] Appl. No.: 09/357,525

[22] Filed: Jul. 19, 1999

Related U.S. Application Data

[63] Continuation-in-part of application No. 09/104,764, Jun. 25, 1998, abandoned, which is a continuation-in-part of application No. 08/961,661, Oct. 31, 1997, abandoned.

[51] Int. Cl.[7] ..... E05G 1/04

[52] U.S. Cl. ..... 109/51; 297/188.2; 297/188.01; 109/52; 70/63

[58] Field of Search ..... 109/50–52, 1 R, 109/23, 45, 49; 70/63, 62, 67; 297/188.2, 188.01

[56] References Cited

U.S. PATENT DOCUMENTS

| | | | |
|---|---|---|---|
| 469,342 | 2/1892 | Nilsen . | |
| 873,855 | 12/1907 | Goldin . | |
| 1,026,649 | 5/1912 | Beshore | 109/50 |
| 2,755,748 | 7/1956 | Abell, Jr. | 70/63 |
| 3,858,531 | 1/1975 | Rubinstein | 109/23 |
| 4,112,717 | 9/1978 | Bradley | 70/63 |
| 4,457,240 | 7/1984 | Hungerford | 70/63 |
| 4,998,424 | 3/1991 | Lambert, II | 70/63 |
| 5,009,088 | 4/1991 | Cislo | 70/63 |
| 5,056,342 | 10/1991 | Prinz | 70/63 |
| 5,551,558 | 9/1996 | Bureau . | |
| 5,595,073 | 1/1997 | Sullivan | 70/63 |

FOREIGN PATENT DOCUMENTS

| | | |
|---|---|---|
| 2306424 | 10/1973 | Germany . |
| 1401125 | 7/1975 | United Kingdom . |

*Primary Examiner*—Darnell Boucher
*Attorney, Agent, or Firm*—Jack C. Munro

[57] ABSTRACT

The lock box which includes a container within which is an internal compartment which is to be mounted onto pool furniture immediately adjacent to a pool to temporarily retain therein personal articles of value of a human. An access door, which is to be operated by a key lock, is formed within the container with the access door, when in the open position, providing access into the internal compartment. The first embodiment of container has mounted thereon a pivotable arm which is to removably engage with an exterior object such as a chair frame. When the arm is in the position of capturing a member of the frame of the chair, the arm is locked by a second key operated lock access to which is only permitted through the internal compartment. A second embodiment of lock box has a hanger in the form of a pawl mounted in conjunction with the top surface of the container for locking onto the frame of the chair. Movement of the pawl from a locking position to an unlocking position being only permitted with the access door in the open position.

8 Claims, 7 Drawing Sheets

LOCK BOX

REFERENCE TO PRIOR APPLICATION

This application is a continuation-in-part of U.S. patent application Ser. No. 09/104,764, filed Jun. 25, 1998, now abandoned, entitled LOCK BOX by the present inventors, which was a continuation-in-part of patent application Ser. No. 08/961,661, filed Oct. 31, 1997, now abandoned, by the same title and same inventors.

BACKGROUND OF THE INVENTION

1) Field of the Invention

The field of this invention relates to security devices and more particularly to a portable lock box which is to be readily mountable on and disengageable from an exterior object such as the frame of a chair, chaise lounge or table and to be kept under the immediate and personal control of the user.

2) Description of the Prior Art

Lock boxes have long been known. A common form of a lock box is deemed to be a safe with the safe having an openable door that will permit entry and removal of valuable articles into and out of the internal compartment of the safe. The openable door of the safe includes a locking mechanism with this locking mechanism only to be operated by the authorized individual or individuals that are to have access to the interior compartment of the safe.

Safes are normally intended to be non-movable objects and are heavy in weight. In certain environments, there is a request and need for a light-weight, portable, safe type of object but where the heavy weight of the safe makes it impossible to use the object in this environment. One such environment would be in conjunction with a swimming pool. It is common to have chairs, chaise lounges and tables mounted on the decking about the swimming pool. It is common for a human to temporarily occupy a chair or chaise lounge while engaging in swimming within the swimming pool. Almost always, the human has certain personal articles, such as personal hygiene articles and valuables such as a room key, a watch, a billfold, glasses and other personal items. When the human is located within the swimming pool, it is not desirable to leave these valuables out in plain sight as it entices a person of criminal tendencies to steal these articles. In the past, facilities that provide swimming pools have provided remotely located, non-portable lockers that could be used by the individual. However, one of the problems associated with the providing of such lockers is that the valuables are not ready at hand for the individual and often not under the personal control of the user. For example, suppose the individual desires to purchase a beverage. This will require the individual to move from the chair or chaise lounge to the remote locker to acquire the means with which to purchase the beverage and then move back to the chair or chaise lounge and make the desired purchase. It would be preferable if the means with which to purchase the beverage was located at the user's chaise lounge or chair not requiring the individual to move to the area of the remote lockers or rely on someone else to open, close or protect the locker.

SUMMARY OF THE INVENTION

The lock box of the present invention is designed to be light in weight, small in size and is to be quickly and easily movable and temporarily attached to an exterior structure and used on a temporary basis to store valuable articles. An intended mode of usage for the lock box of the present invention is to be attached to the frame of furniture such as a chair, chaise lounge or table in an area that is commonly used by humans such as around a swimming pool. The lock box is defined primarily by a container which has an internal compartment within which is to be stored the valuable articles. An access door is provided in the container with the access door being lockable by a manually operated lock which could comprise either a combination type lock or a key type lock solely under the personal control of the user. In a first embodiment of lock box the access door can be opened and has a mirror mounted on its inside surface. The door can be stood up in a particular open position with the mirror being used to reflect the image of the user. The container has attached thereto an arm with this arm to be connectable around a frame member of the furniture and a lock being utilized to lock the arm in position thereby attaching of the lock box to the furniture. Access to the lock of the arm is to be provided only from within the internal compartment of the container. A pair of leg assemblies are to be pivotally mounted to the container and are to be pivoted from a retracted position to a usage position with the leg assemblies coming into contact with the supporting surface on which the furniture is located. The leg assemblies are to be utilized to position the container in the position facilitating usage of the mirror. In a second embodiment of lock box, there is formed a short wall indentation in the top surface of the container with a pawl extending externally through the short wall. The pawl is movable internally and externally between a locking position and an unlocking position. When in the locking position, a furniture frame member is capturable between the pawl and the short wall indentation and locked internally against a restraint. When in the unlocking position, the pawl is movable from the restraint into and out of engagement with the furniture frame member. The pawl can only be moved off the restraint to the unlocking position when the access door is open.

The primary objective of the present invention is to construct a portable, personal, secure lock box that is to be attachable to an exterior structure of a furniture member in immediate proximity of a user at a swimming pool which can be used to temporarily store valuable articles while a user is engaged in a particular activity such as sun bathing and/or swimming.

Another objective of the present invention is to construct a light-weight lock box which can be quickly and easily attached to the exterior structure and also quickly and easily detached from the exterior structure.

Another objective of the present invention is to construct a lock box which can be easily attached and detached by the user from the exterior structure not requiring any special skill.

Another objective of the present invention is to provide a lock box under a swimmer's immediate control which can provide immediate and frequent access to valuables and personal items necessary to take to and use in connection with their use of a swimming pool.

Another objective of the present invention is to provide a way to reserve a lounge chair to provide other swimmers from taking one's lounge chair while one is swimming, buying food or using the lavatory.

Another objective of the present invention is to construct a lock box which can be manufactured at a relatively inexpensive price and thereby sold or rented by a pool operator to the ultimate user at a relatively inexpensive price.

Another objective of the present invention is to fill a need expressed by resort hotels, cruise ships and other places offering a pool to provide a readily accessible, personally controlled small box into which valuables may be kept immediately at hand while the user swims, eats or goes to the lavatory from around the pool.

Another objective of the present invention is to fill a need expressed by pool users for a lockable unit attached to their pool lounge or chair immediately available to the user when and as required.

DETAILED DESCRIPTION OF THE PREFERRED EMBODIMENT

Figure 1:
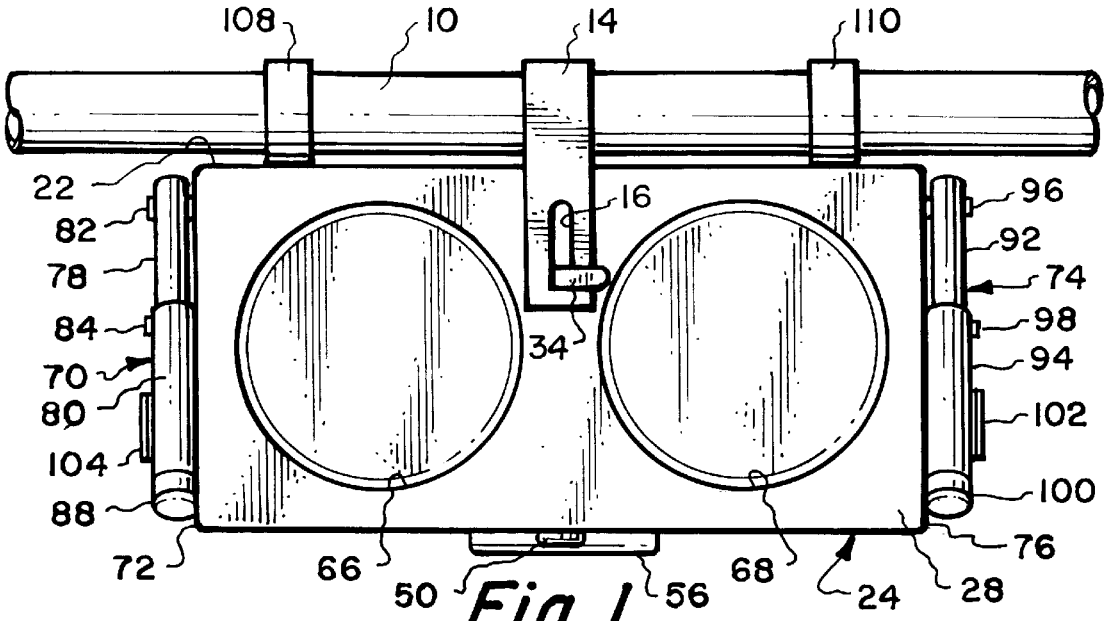
FIG. 1 is a top plan view of the first embodiment of lock box of the present invention showing the lock box mounted on the frame member of furniture or table showing the lock box in the closed position.

Referring particularly to the drawings, there is shown a tubular member 10 which is to be attached to an exterior structure such as furniture. Typically, the furniture will comprise a table, a chair or chaise lounge. As for this invention, the term chair will include a chaise lounge and tables. However, it is considered to be within the scope of this invention that the tubular member 10 could be part of any exterior structure and not necessarily restricted to furniture.

The tubular member 10 is to be locatable within a pocket 12 of an arm 14 of the first embodiment of lock box shown in FIGS. 1–5. The upper end of the arm 14 has a slot 16. The lower end of the arm 14 is connected to a hinge 18. The hinge 18 is connected to a hinge plate 20 with this hinge plate 20 being fixedly mounted onto the back wall 22 of a container 24. The container 24 is formed in a box-like configuration having six sides which also include a front wall 26 and a top wall 28. The container 24 will normally be constructed of sheet material with generally a plastic or metal type of sheet material being preferred. The container 24 includes an internal compartment 30. It is within the internal compartment 30 that there are to be valuable articles temporarily stored. In order to prevent the accumulation of any mildew within the internal compartment 30, the walls of the container 24 will likely include a series of ventilation holes 32.

Figure 4:
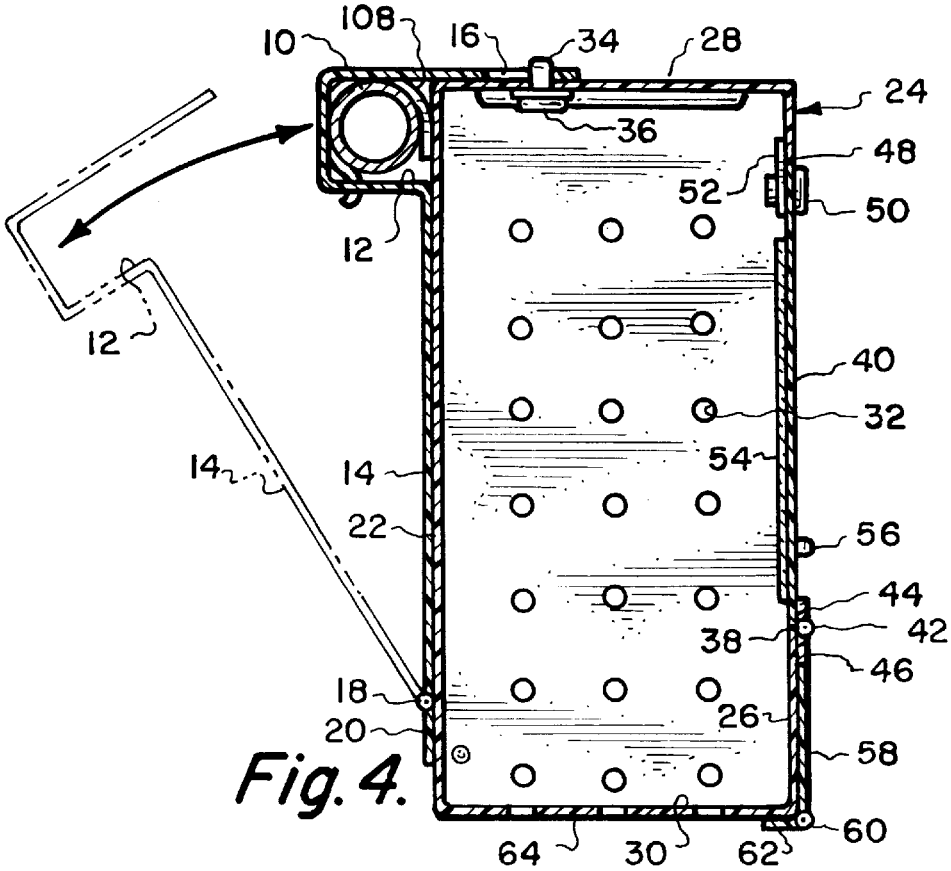
FIG. 4 is a cross-sectional view taken along line 4—4 of FIG. 2.

With the arm 14 in the closed or locked position, as shown in solid lines in FIG. 4, slot 16 connects with a pawl 34. The pawl 34 can be inserted through the slot 16 and then turned about ninety degrees which will result in a locking of the arm 14 onto the container 24. The pawl 34 is to be connected to a locking mechanism 36. The locking mechanism 36 can be operated with a key with access to the locking mechanism 36 being from within the internal compartment 30. It is to be understood that the locking mechanism 36 can result in the pawl 34 being located in a locking position as shown in FIG. 1 of the drawings or to be moved to an unlocking position which places the pawl 34 in alignment with the slot 16 which will permit the arm 14 to be pivoted to the dotted line position as shown in FIG. 4. This is to be deemed the unsecured or box removal position with the solid line position of the arm in FIG. 4 being deemed the secured position. With the arm 14 in the dotted line position as shown in FIG. 4, this is the position that is required in order to install the lock box of this invention onto the tubular member 10. It is also the position that is required in order to remove the lock box of this invention from the tubular member 10.

Figure 5:
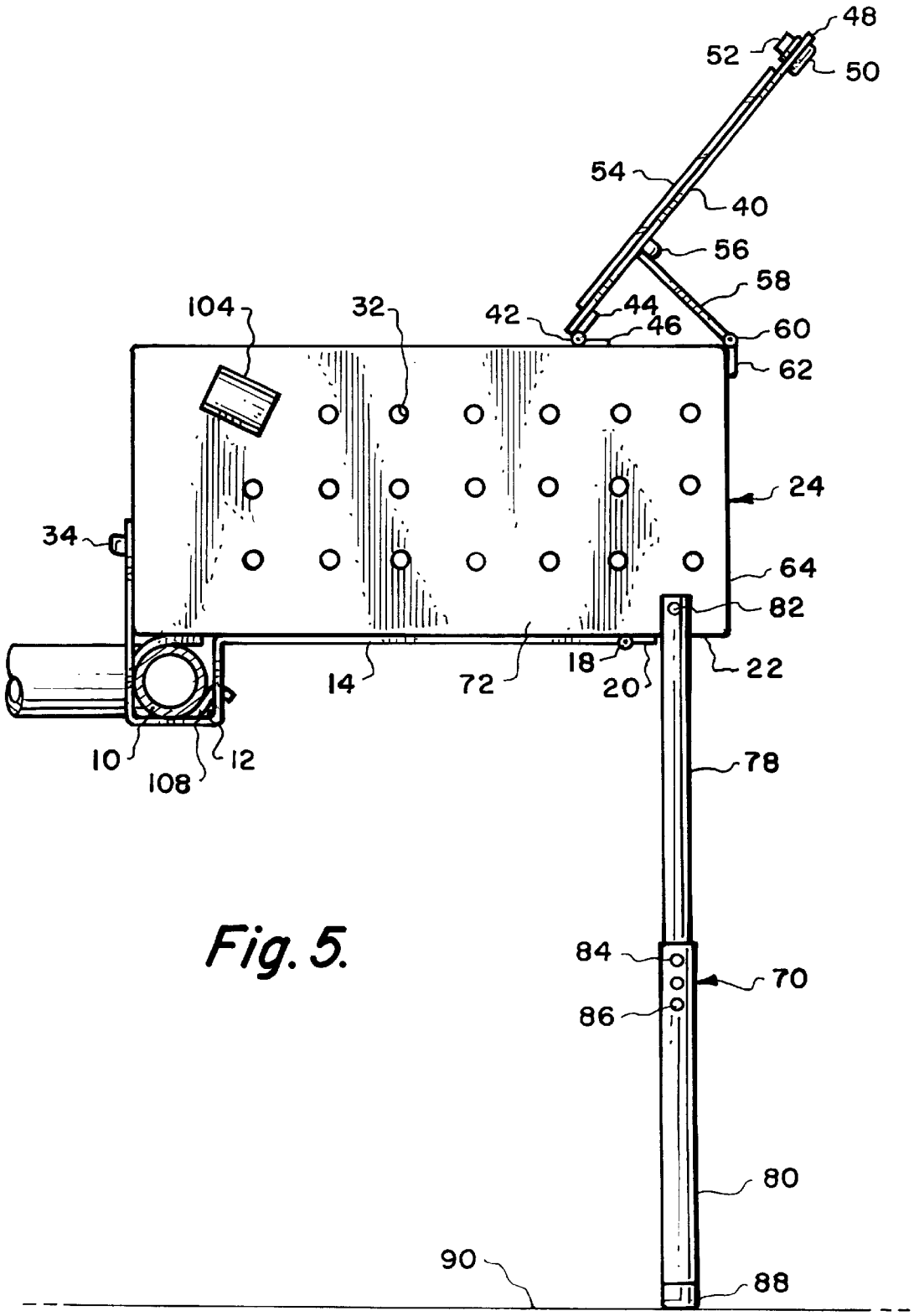
FIG. 5 is a left side view of the lock box showing it in the position being supported on the supporting surface with the access door of the container of the lock box being shown in the stand-up open position.
Figure 6:
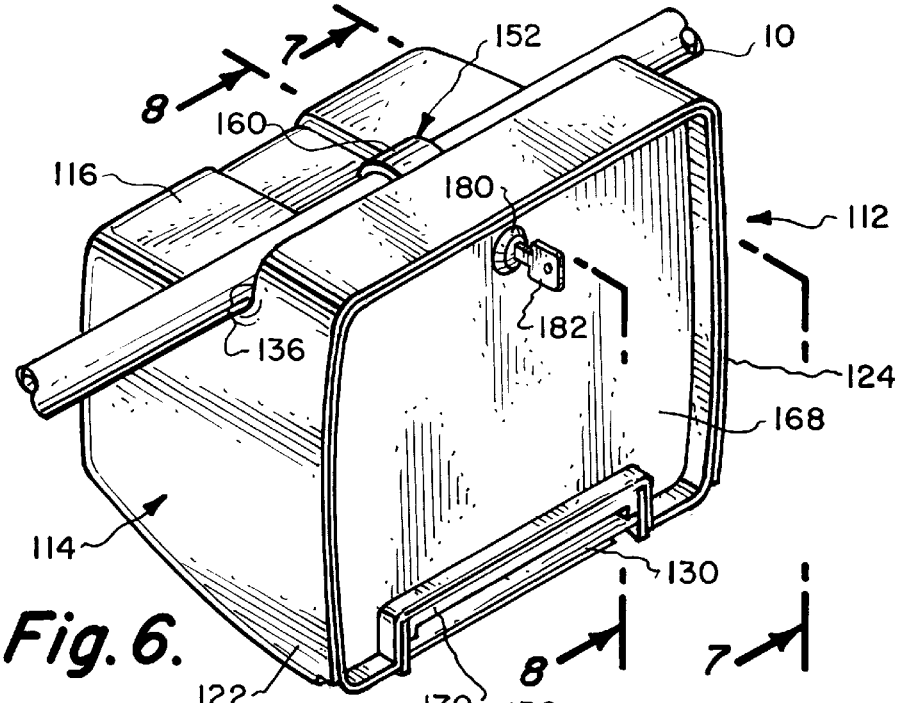
FIG. 6 is an isometric view of the second embodiment of lock box of this invention showing the lock box in its locked position.
Figure 7:
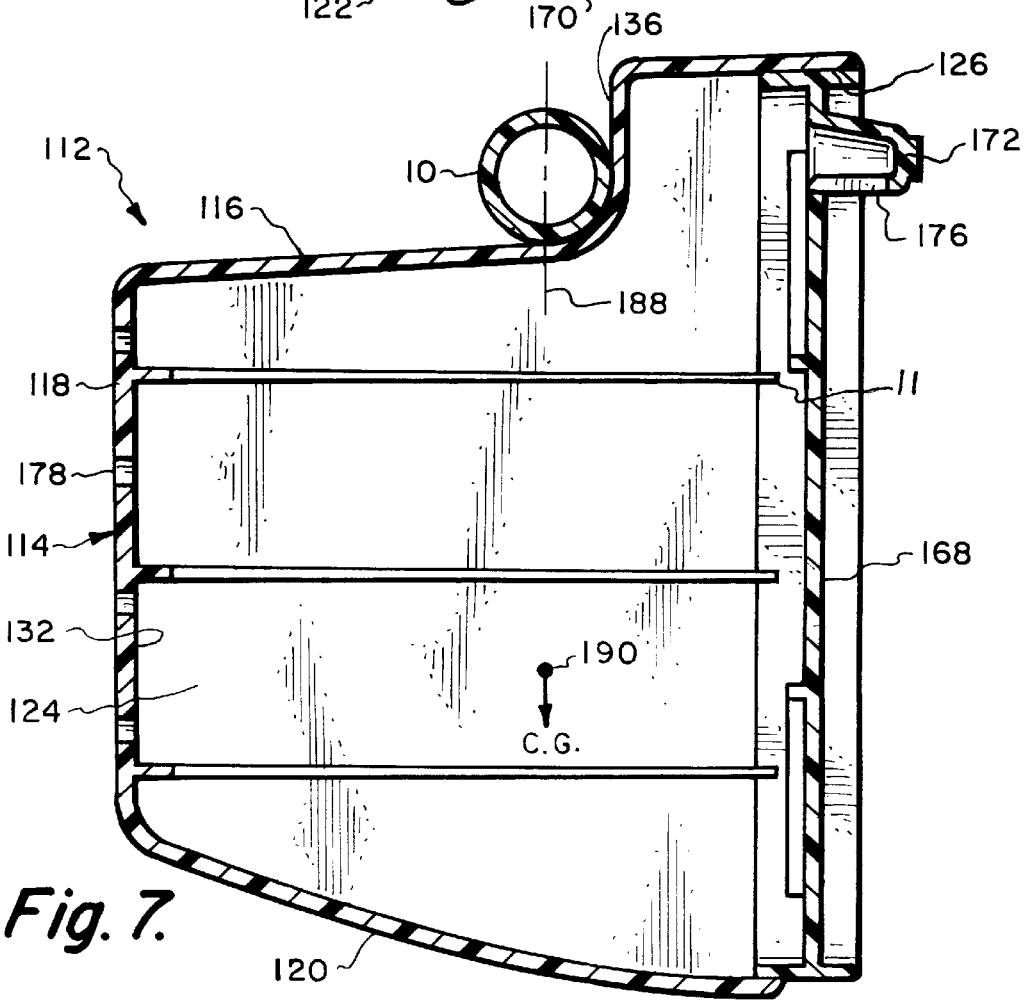
FIG. 7 is a cross-sectional view taken along line 7—7 of FIG. 6.
Figure 8:
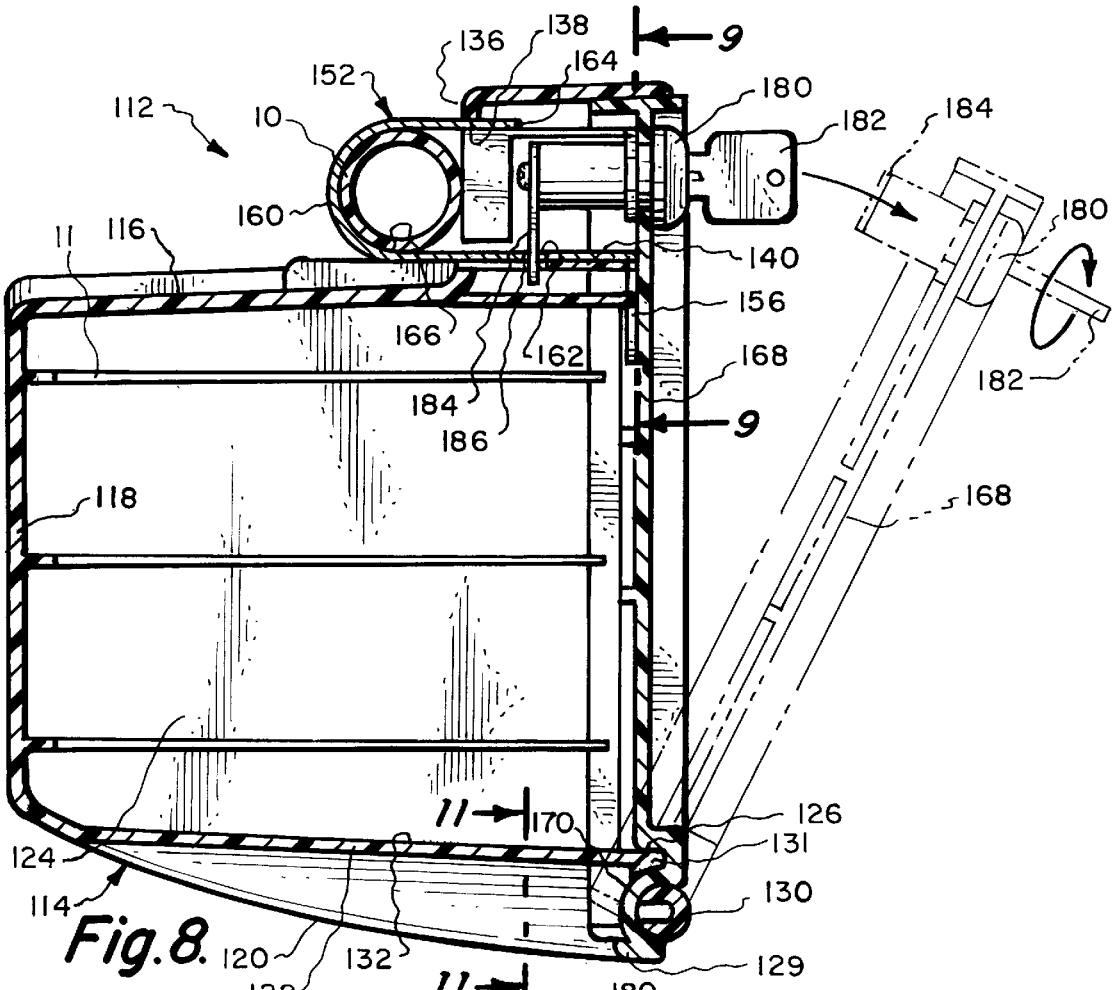
FIG. 8 is a cross-sectional view taken along line 8—8 of FIG. 6.
Figure 9:
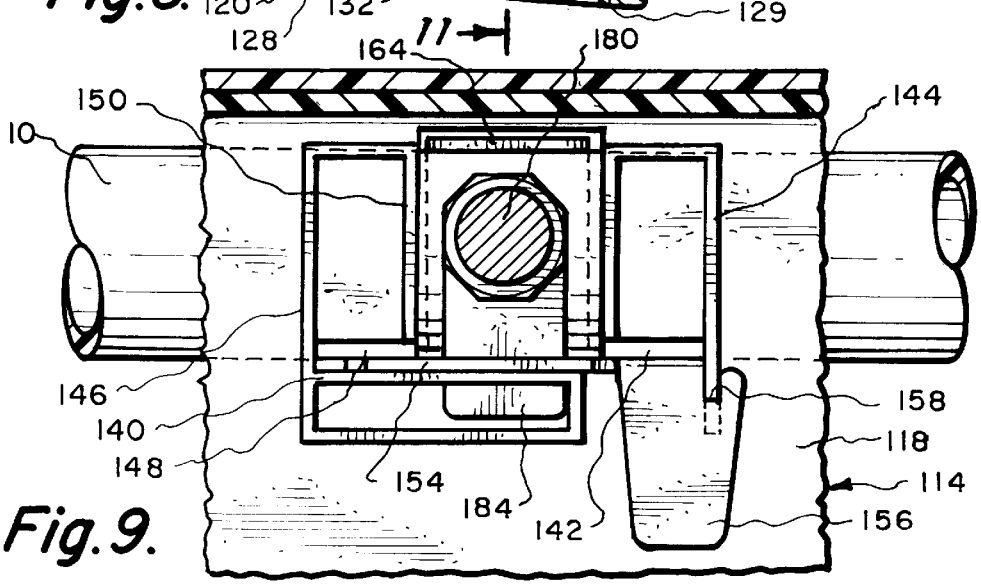
FIG. 9 is a view partly in cross-section taken along line 9—9 of FIG. 8 showing in more detail the locking mechanisms included within the lock box of the present invention.
Figure 10:
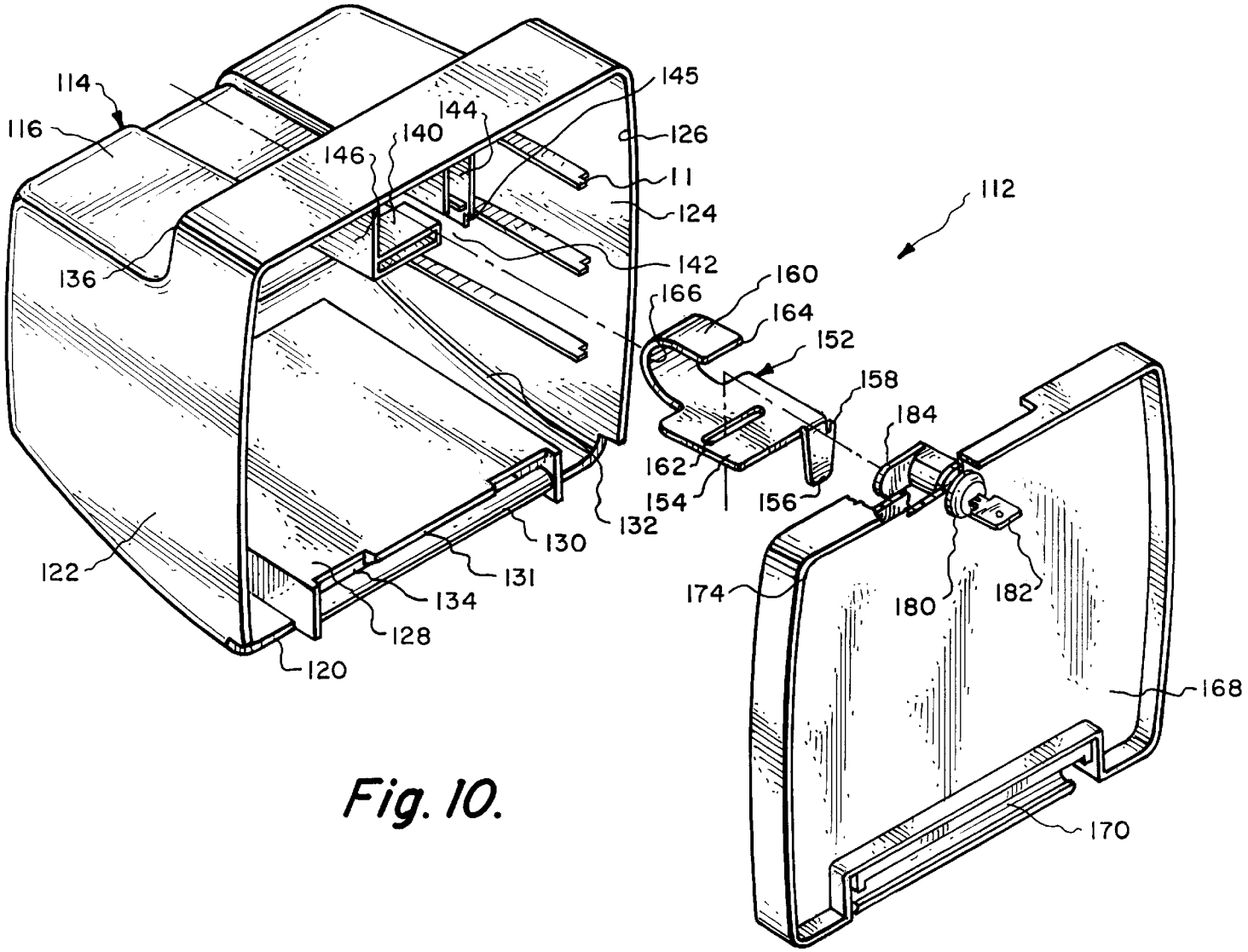
FIG. 10 is an exploded isometric view of the second embodiment of lock box of this invention.
Figure 11:
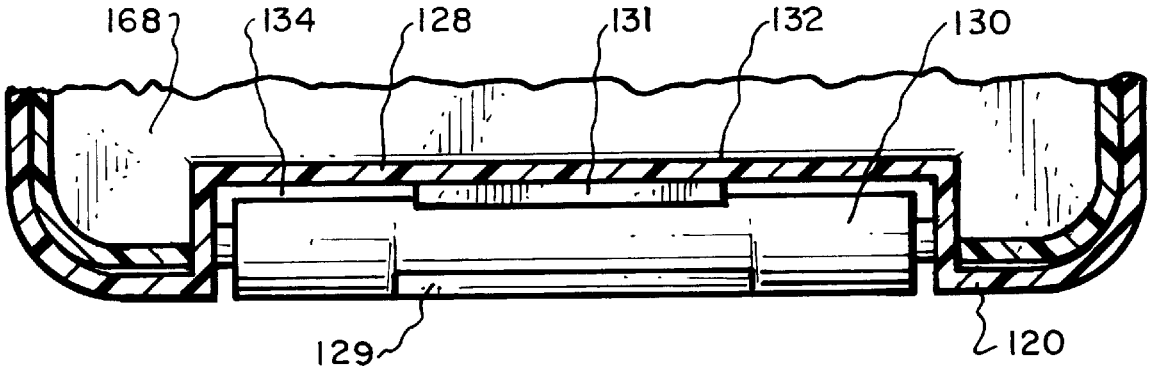
FIG. 11 is a longitudinal cross-sectional view taken along line 11—11 of FIG. 8 through the hinge mounting the access door to the housing of the second embodiment taken in a direction toward the access door with the access door closed.
Figure 12:
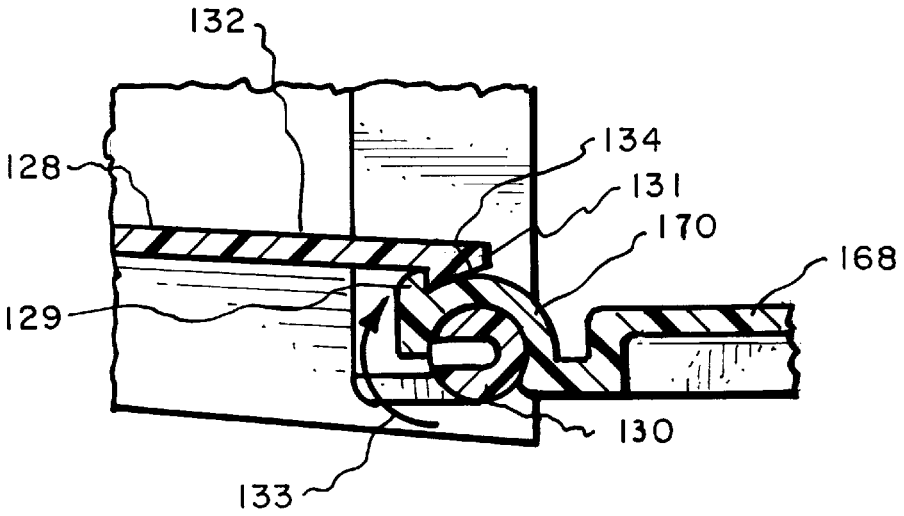
FIG. 12 is a transverse cross-sectional view through the hinge shown in FIG. 11.

Formed within the front wall 26 is an enlarged opening 38. This opening 38 is normally closed by an access door 40. The lower edge of the access door 40 is pivotally mounted by means of a hinge 42 to the front wall 26. The hinge 42 is connected to the lower edge 44 of the access door 40. The hinge 42 includes a hinge plate 46 which is fixedly mounted to the front wall 26. Mounted within the access door 40 and located directly adjacent the upper edge 48 of the access door 40 is a locking mechanism 50. Typically, the locking mechanism 50 will comprise a key operated type of lock. The locking mechanism 50 is capable of moving the pawl 52 between a locking position in engagement with the inside surface of the front wall 26 as shown in FIG. 4 of the drawings to a ninety degree displaced position as shown in FIG. 5 of the drawings which will permit access to the internal compartment 30 through the opening 38. The movement of the door 40 is by means of pivoting due to the hinge 42. The key that operates the locking mechanism 50 will, in all probability, also operate the locking mechanism 36. However, it is considered to be within the scope of this invention that two separate keys could be utilized and possibly even the locking mechanism 36 not being key operated at all. It is also considered within the scope of this invention the locking mechanism 50 could be a combination type of lock.

Mounted on the inside surface of the access door 40 is a mirror 54. Fixed on the front surface of the access door 40 is a bar 56. The bar 56 is to function as a stop with the outer end of a brace 58 being in contact with the access door 40 and abutting against the bar 56. This will locate the access door 40 in a stand-up position with basically the access door 40 being about one hundred thirty five degrees displaced from its closed position in conjunction with the opening 38. This will locate the mirror 54 in a convenient position so that a human can observe the mirror 54 when the lock bock of the present invention is in the position shown in FIG. 5. The mirror 54 would normally be used by women to adjust their makeup, comb their hair, etc.

The brace 58 constitutes a thin plate which is pivotally mounted by means of a hinge 60 to a hinge plate 62. The hinge plate 62 is fixedly mounted to the bottom wall 64 of the container 24 although the hinge plate 62 could be mounted on the front wall 26. When the access door 40 is not located in the stand-up position as shown in FIG. 5, the brace 58 is to be placed in abutting contact with the front wall 26 of the container 24. This position is clearly shown in FIGS. 2, 3 and 4 of the drawings.

Figure 2:
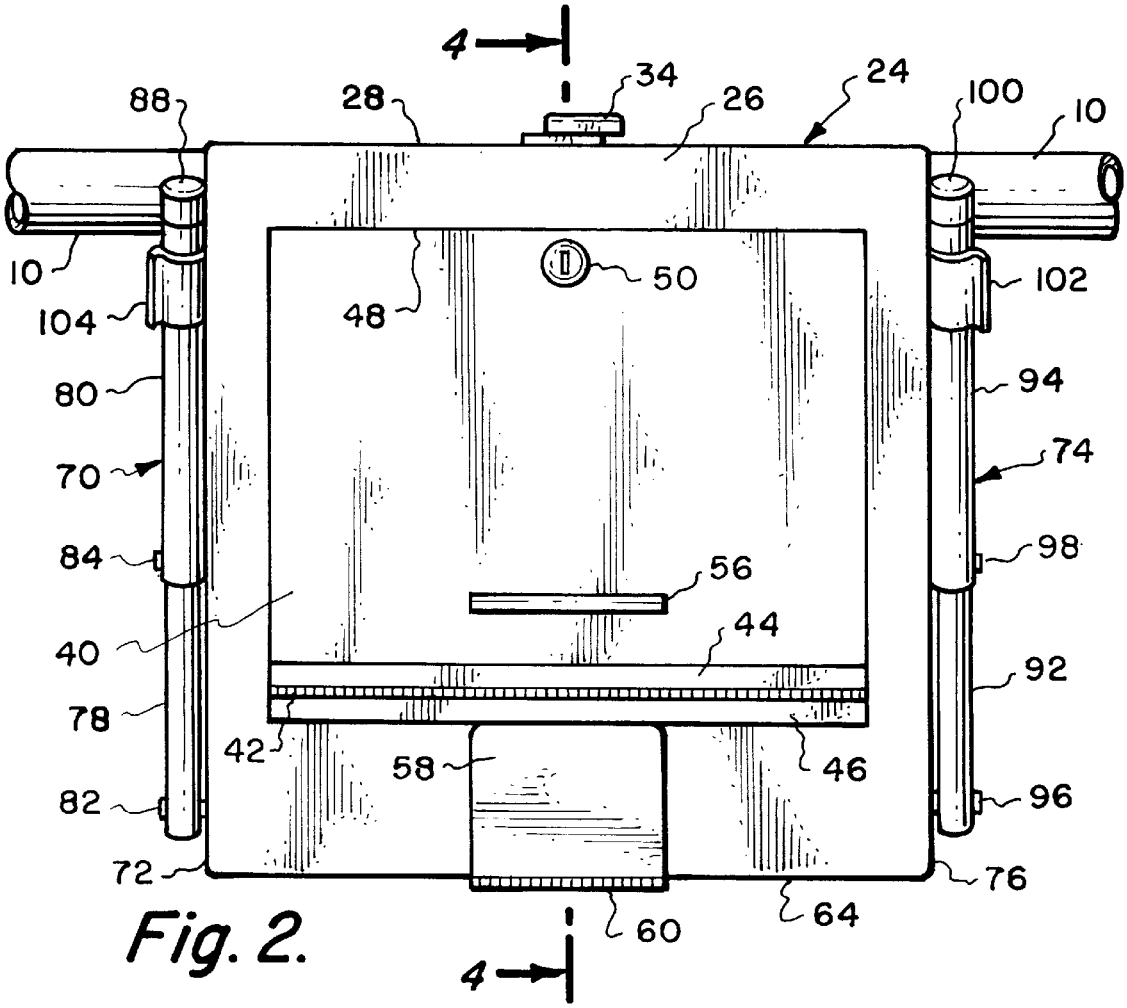
FIG. 2 is front view of the lock box of FIG. 1.
Figure 3:
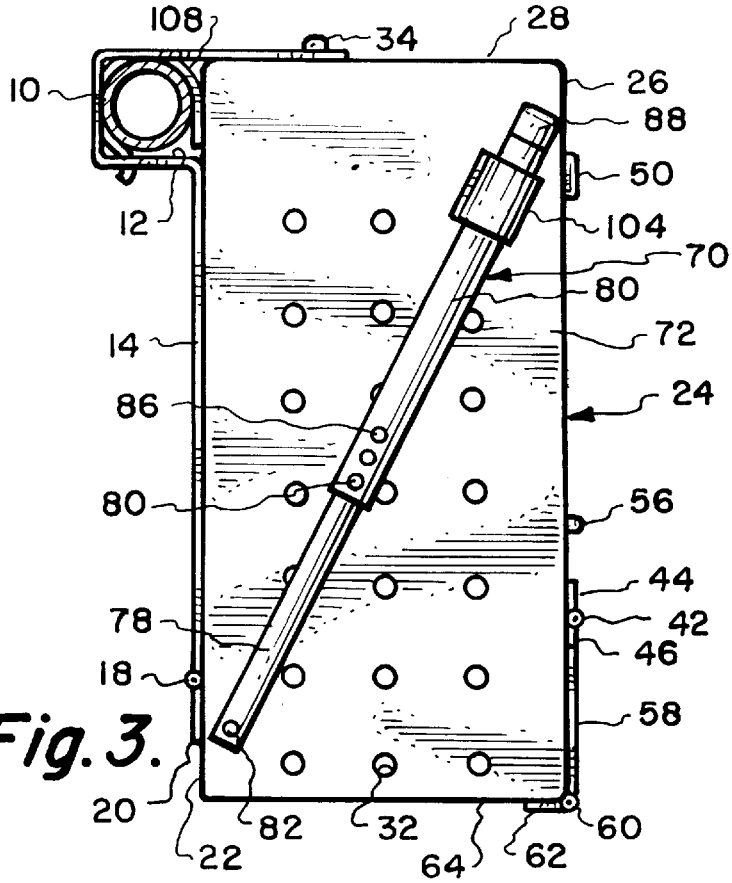
FIG. 3 is a left side view of the lock box of FIG. 1.

Formed within the top wall 28 are a pair of enlarged recesses 66 and 68. It is the function of the recesses 66 and 68 to be for the purpose of connecting with the beverage glass or bottle when the container 24 is in the position shown in FIGS. 1–4 of the drawings. The position of FIGS. 1–4 of the drawings would be the normal usage position for the lock box of this invention. However, if the user wishes to take advantage of the mirror 54, it would be desirable to position the container 24 at a ninety degree displaced position from that of FIGS. 1–4. This displacement is shown in FIG. 5. However, since the arm 14 can readily pivot about the tubular member 10, some device is necessary to support the container 24 in the position shown in FIG. 5. This device is in the form of a leg assembly 70 mounted on the side wall 72 of the container 24 and a leg assembly 74 mounted on the side wall 76 of the container 24. The leg assembly 70 is composed of an upper leg member 78 and a lower leg member 80. The upper leg member 78 is telescopingly received within the lower leg member 80. The upper leg member 78 is pivotally mounted by means of a pivot pin 82 to the side wall 72. Mounted in conjunction with the outer end of the upper leg member 78 is a pressable button 84. Button 84 is to be engageable with any one of a series of holes 86 formed within the lower leg 80. There are three in number of such holes 86 being shown. It is to be understood that the holes 86 are slightly spaced apart. The leg members 78 and 80 can be pivoted approximately one hundred thirty five degrees from the retracted or stowage position as shown in FIGS. 1, 2 and 3 to the extended position as shown in FIG. 5. The outer tip 88 of the lower leg member 80 is to rest in contact with the supporting surface 90. By selecting with which hole 86 the button 84 is to engage, the position of the container 24 can be adjusted which thereby will also vary the positions of the mirror 54.

It is to be understood that the leg assembly 74 is basically identical to leg assembly 70 by being constructed of an upper leg member 92 and a lower leg member 94 with the upper leg member 92 pivotally mounted by means of a pivot pin 96 to the side wall 76. The lower leg member 94 is to be adjustably movable relative to the upper leg member 92 and is to be lockable in a fixed position by means of depressible button 98. Tip 100 of the lower leg member 94 is to be in contact with the supporting surface 90.

A spring biased U-shaped clip member 104 is fixedly mounted to the side wall 72 and is to function to engage with and restrain the lower leg member 80 when in the retracted or stowage position as shown in FIG. 3. In a similar manner, the lower leg member 94 is to lockingly connect with clip member 102 which is mounted on the side wall 76.

Fixedly mounted to the back wall 22 in a spaced-apart arrangement are a pair of hook members 108 and 110. The hook members 108 and 110 are to be snappingly located about the tubular member 10 to perform part of the secure support mounting arrangement of the lock box of this invention on the tubular member 10. With the hook members 108 and 110 connecting with the tubular member 10, the arm 14 is located in its closed or locking position as shown in solid lines in FIGS. 1, 3, 4 and 5 of the drawings.

A typical procedure that is envisioned for the use of the first embodiment of lock box shown of this invention is that a user is to acquire the lock box in the configuration shown in FIG. 3 of the drawings with the exception that it is not attached to the tubular member 10. The user is to move the locking mechanism 36 to the unlocking position which will permit the arm 14 to be pivoted to the dotted line position shown in FIG. 4. The user will then install the hook members 108 and 110 in conjunction with the tubular member and then pivot the arm 14 to the closed or locking position as shown in FIG. 4. The locking mechanism 36 is then moved to the locking position which now fixedly attaches the container 24 to the tubular member 10. Valuables that are intended to be stored within the internal compartment 30 can then be placed within internal compartment 30 and the access door 40 then closed. It is to be understood that prior to installation of the container 24 onto the tubular member 10 that the access door 40 would be located in the open position. With the access door 40 closed, the locking mechanism 50 is then moved to the locking position. If the user wishes, the user could locate a beverage bottle or beverage container such as a drinking glass or coffee cup in conjunction with either one or both of the recesses 66 and 68.

If the user wishes to move container 24 to the position shown in FIG. 5, the leg assemblies 70 and 74 will then be pivoted to the outwardly extended position as shown in FIG. 5 with the tips 88 and 100 contacting the supporting surface 90. The access door 40 is then moved to the open position and mounted in a stand-up position with the access door 40 connecting with brace 58 which has now been pivoted in its outwardly extended position and placed under bar 56 as shown in FIG. 5.

Referring particularly to FIGS. 6–12 of the drawings, there is shown the second embodiment 112 of lock box of this invention. The second embodiment 112 is comprised of a thin wall enclosing container 114 which has a top wall 116, a back wall 118, a bottom wall 120 and sidewalls 122 and 124. Where there would normally be a front wall if the container 114 would be totally enclosing, there is instead an enlarged access opening 126. The bottom wall 120 includes a raised section 128 which forms a platform within the internal compartment 132 of the container 114. The forward end of the raised section 128 includes a hinge rod 130. Between the hinge rod 130 and the raised section 128 there is a gap area 134 into which the elongated protuberance 131 extends. The wall surface of the internal compartment includes a series of stiffening ribs 11.

The top surface 116 has an enlarged indentation which forms a short wall 136. The short wall 136 extends entirely between the sidewalls 122 and 124. The short wall 136 has an opening 138 which connects to the internal compartment 132. Mounted within the internal compartment 132 directly adjacent the opening 138 is a shelf 140. The shelf 140 has a longitudinal slot 142 which connects with the opening 138. One side of the slot 142 is closed by a right side barrier wall 144. The shelf 140 is supported relative to the undersurface of the top wall 116 by means of a left side barrier wall 146. There is a longitudinal slit 148 formed between intermediate wall 150 and the shelf 140. It is to be noted that the entire container 114 will normally be constructed of a plastic material.

A rigid metallic locking pawl 152 has a planer base 154. Integrally connected to the front edge of the planer base 154 is a right angled section which is referred to as a handle 156. Handle 156 includes a notch 158. Integrally connected to the rear edge of the planer base 154 is a U-shaped member 160. Formed within the planer base 154 is an elongated locking slot 162.

The base 154 is designed to travel and rest on the shelf 140. The locking pawl 152 is designed to be moved inwardly, the handle 156 moving toward opening 138. This movement is to be continued until there is enough clearance between the free edge 164 of the U-shaped member 160 and the short wall 136 that will permit the tubular member 10 of a furniture chair to be inserted within the confined area 166 of the U-shaped member 160. The handle 156 is then pulled in an outward direction away from the opening 138 which will result in the tubular member 10 being moved to abutting contact against the short wall 136. The tubular member 10 is now captured by the U-shaped member 160. To maintain this captured relationship, the handle 156 is then physically moved slightly outwardly and then lifted and moved laterally until the notch 158 engages the cutout 145 of the right side barrier wall 144. Engaged notch 158 and cutout 145 comprise a restraint. The locking pawl 152 is now locked in position.

In order to close off the access opening 126, there is provided an access door 168. The lower edge of the access door is formed into a curved flange 170. Curved flange 170 is to be inserted within the gap area 134 with the access door 168 then pivoted to position to close off the access opening 126. The curved flange 170 and the hinge rod 130 form a conventional type of hinge for the access door 168. The inner side of curved flange 170 is to include an elongated protuberance 129. The underside of the front raised section 128 also includes an elongated protuberance 131. These two protuberances 129 and 131 are to abut when the access door 168 is in the maximum open position which is about ninety degrees from the closed position with the door opening direction being indicated by arrow 133. These protuberances 129 and 131 thereby function as a movement limiting device for the access door 168 limiting open movement of the access door 168 to about ninety degrees.

Also mounted within the access door 168 is a pick resistant key lock 180. The key lock 180 is to be actuated by means of a key 182 which is removable from the key lock 180 when such is in the locked position. The key lock 180 includes a latch plate 184. Turning of the key 182 from an unlocked to a locked position with the access door 168 closed will result in the latch plate 184 being pivoted ninety degrees to be conducted simultaneously through elongated locking slot 162 and slot 186. Elongated slot 162 is aligned with a slot 186 which is formed in shelf 140. As a result, not only is the access door 168 locked by key 180 in the closed position, but also the position of the access door 168 is held against locking pawl 152 preventing any retraction movement of the locking pawl 152 as the access door 168 in the closed position abuts against the handle 156. This further insures that the notch 158 remains connected to the cutout 145 when the access door 168 is closed. Only when the access door 168 is moved to the open position, which is depicted in phantom lines in FIG. 8, will it be possible to disconnect the notch 158 from the cutout 145 and move the locking pawl 152 to the retracted position permitting disengagement with the tubular member 10.

Usage of the second embodiment 112 of lock box of this invention is for valuables to be inserted within the internal compartment 132 when the second embodiment 112 of the lock box is mounted on the tubular member 10 and pawl 152 is still restrained by cutout 145. The access door 168 is then to be closed holding handle 156 in a locked position and the key 182 pivoted in conjunction with the key lock 180. Pivoting of the key 182 will result in the latching plate 184 connecting with the aligned slots 162 and 186. The key 182 can then be removed with the result that the second embodiment 112 is securely locked onto the tubular member 10. Access to the valuables contained within the internal compartment 132 is only permitted by reengagement of the key 182 and pivoting of the key 182 so that the latch plate 184 is disengaged from the slots 162 and 186 which will then result in the access door 168 being movable to the open position. This can be done without removal of pawl 152 from the cutout 145 holding the pawl 152 in a locked position if the second embodiment 112 of the lock box is not to be removed from the tubular member 10 at that time.

The position of the short wall 136 is selected so that the hanging axis 188 aligns with the center of gravity 190 of the second embodiment 112. The result is when the second embodiment 112 is mounted on the tubular member 10, the second embodiment 112 will hang in such a manner that the access door 168 is substantially vertical when closed and locked.

What is claimed is:

1. A lock box comprising:

a container having an internal compartment, an access door mounted on said container, said access door being movable between a closed position and an open position, said closed position preventing access into said internal compartment, said open position permitting access into said internal compartment, a manually operated locking mechanism connected to said access door, said manually operated locking mechanism to be operated to permit said access door to be moved to said open position; and a locking pawl mounted on said container, said locking bawl being movable between a locking position and an unlocking position, said locking position for locking said container to an exterior object, said unlocking position for permitting engagement and disengagement of said locking pawl with the exterior object, said locking pawl being held by a restraint located within said internal compartment when in said locking position, when said locking pawl is in said unlocking position said locking pawl is spaced from said restraint, said restraint being separate from said access door, with said access door in said closed position and said locking pawl connecting with said restraint said locking pawl being forced to remain in said locking position by the location of said access door which is located directly adjacent said restraint preventing movement of said locking pawl, upon movement of said access door to said open position said locking pawl is movable to said unlocking position.

2. The lock box as defined in claim 1 wherein:

said container having a top and a back each of which are located between sidewalls, said back being opposite said access door, said top having an indentation forming a short wall which is parallel to said access door and located exteriorly of said internal compartment, said short wall extends entirely between said sidewalls, said short wall having an opening, said locking pawl being mounted within said opening with a first part of said locking pawl extending exteriorly of said container and a second part of said locking bawl extending within said internal compartment, said locking position to capture the exterior object in abutting contact with said short wall and suspending said container on a hanging axis on the exterior object.

3. The lock box as defined in claim 2 wherein:

said container having a center of gravity, said short wall being located nearer said access door than said back in order to align said hanging axis with said center of gravity.

4. A lock box comprising:

a container having an internal compartment, an access door mounted on said container, said access door being movable between a closed position and an open position, said closed position preventing access into said internal compartment, said open position permitting access into said internal compartment, a manually operated locking mechanism connected to said access door, said manually operated locking mechanism to be operated to permit said access door to be moved to said open position;

a locking pawl mounted on said container, said locking bawl being movable between a locking position and an unlocking position, said locking position for attaching said container to an exterior object, said unlocking position for permitting engagement and disengagement of said locking pawl with the exterior object, said container having an opening, said locking pawl being mounted within said opening with a first part of said locking pawl extending exteriorly of said container and a second part of said locking pawl being located within said internal compartment, said unlocking position being adapted to permit entry and removal of a furniture frame member relative to said locking pawl, said locking position to capture the furniture frame member by said locking pawl positioning the furniture frame member in abutting contact with said container and suspending said container on a hanging axis on the furniture frame member; and a restraint located within said internal compartment, said locking pawl to connect with said restraint when in said locking position maintaining said locking pawl in said locking position, when said locking pawl is in said unlocking position said locking pawl is spaced from said restraint, said restraint being separate from said access door, said access door when in the closed position preventing disengagement of said locking pawl from said restraint by the location of said access door which is directly adjacent said restraint preventing movement of said locking pawl.

5. A lock box comprising:

a container having an internal compartment, an access door mounted on said container, said access door being movable between a closed position and an open position, said closed position preventing access into said internal compartment, said open position permitting access into said internal compartment, a manually operated locking mechanism connected to said access door, said manually operated locking mechanism to be operated to permit said access door to be moved to said open position;

a locking pawl mounted on said container, said locking pawl being movable between a locking position and an unlocking position, said locking position for attaching said container to an exterior object, said unlocking position for permitting engagement and disengagement of said locking pawl with the exterior object, said container having an opening, said locking pawl being mounted within said opening with a first Part of said locking pawl extending exteriorly of said container and a second part of said locking pawl being located within said internal compartment, said unlocking position being adapted to permit entry and removal of a furniture frame member relative to said locking pawl, said locking position to capture the furniture frame member by said locking pawl positioning the furniture frame member in abutting contact with said container and suspending said container on a hanging axis on the furniture frame member; and said container having a top and a back each of which are located between sidewalls, said back being located opposite said access door, said top having an indentation forming a short wall which is parallel to said access door and located exteriorly of said internal compartment, said short wall extends entirely between said sidewalls, the furniture frame member to be located in abutting contact with said short wall when the furniture frame member is captured by said locking pawl and in said locking position.

6. A lock box comprising:

a container having an internal compartment, an access door mounted on said container, said access door being movable between a closed position and an open position, said closed position preventing access into said internal compartment, said open position permitting access into said internal compartment, a manually operated locking mechanism connected to said access door, said manually operated locking mechanism to be operated to permit said access door to be moved to said open position; and said container having a top and a back each of which are located between sidewalls, said back being located opposite said access door, said top having an indentation forming a linear, elongated short wall which is parallel to said access door and located exteriorly of said internal compartment, said short wall extends entirely between said sidewalls, whereby a furniture frame member is adapted to be placed in abutting contact with said short wall with said container being engaged with the furniture frame member.

7. The lock box as defined in claim 6 wherein:

said short wall having an opening, a locking means mounted on said container, said locking means being mounted within said opening, said locking means being movable between a locking position and an unlocking position, with said locking means in said locking position the furniture frame member is to be captured and maintained in contact with said short wall.

8. The lock box as defined in claim 7 wherein:

a restraint located within said internal compartment, said locking means to be connectable with said restraint when in said locking position, said access door preventing disengagement of said locking means from said restraint when said access door is in said closed position by the location of said access door which is located directly adjacent said restraint preventing movement of said locking means.

* * * * *